US007690741B2

(12) United States Patent
Tyvoll et al.

(10) Patent No.: US 7,690,741 B2
(45) Date of Patent: Apr. 6, 2010

(54) INTRODUCING INK INTO AN INK CARTRIDGE

(75) Inventors: David A. Tyvoll, San Diego, CA (US); Winthrop D. Childers, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 420 days.

(21) Appl. No.: 11/606,261

(22) Filed: Nov. 28, 2006

(65) Prior Publication Data

US 2008/0100679 A1 May 1, 2008

Related U.S. Application Data

(63) Continuation-in-part of application No. 11/589,526, filed on Oct. 30, 2006.

(51) Int. Cl.

| | |
|---|---|
| ***B41J 2/195*** | (2006.01) |
| ***B41J 2/175*** | (2006.01) |
| ***B67C 3/20*** | (2006.01) |
| *B41J 2/19* | (2006.01) |

(52) U.S. Cl. ..... 347/7; 347/87; 347/92; 141/18

(58) Field of Classification Search ..... 347/7; 141/18

See application file for complete search history.

(56) References Cited

U.S. PATENT DOCUMENTS

| | | | | |
|---|---|---|---|---|
| 5,663,754 | A * | 9/1997 | Lorenze, Jr. et al. | 347/87 |
| 5,704,403 | A | 1/1998 | Schwenk et al. | |
| 5,801,735 | A | 9/1998 | Lorenze, Jr. et al. | |
| 7,527,365 | B2 * | 5/2009 | Mori | 347/84 |
| 2001/0050113 | A1 * | 12/2001 | Shinada et al. | 347/86 |
| 2004/0257409 | A1 * | 12/2004 | Cheok | 347/84 |
| 2005/0034777 | A1 * | 2/2005 | Nicodem et al. | 141/2 |
| 2005/0128260 | A1 * | 6/2005 | Su et al. | 347/85 |
| 2006/0244791 | A1 * | 11/2006 | Chung et al. | 347/85 |
| 2007/0052767 | A1 * | 3/2007 | Guhse et al. | 347/7 |

FOREIGN PATENT DOCUMENTS

| | | |
|---|---|---|
| DE | 19637235 | 10/1997 |

OTHER PUBLICATIONS

International Search Report and Written Opinion of the International Searching Authority dated Mar. 7, 2008.

* cited by examiner

*Primary Examiner*—Matthew Luu
*Assistant Examiner*—Shelby Fidler

(57) ABSTRACT

In one embodiment, a method for introducing ink into an ink cartridge includes introducing ink into an ink holding chamber through ink ejection nozzles and, simultaneously with introducing ink into the ink holding chamber through the ink ejection nozzles, introducing ink into the ink holding chamber through an opening other than the ink ejection nozzles or applying a negative pressure at a first opening to the ink holding chamber and applying a positive pressure at a second opening to the ink holding chamber. In another embodiment, a method includes performing a primary operation on an ink holding chamber by introducing ink into the ink holding chamber through ink ejection nozzles and performing a secondary operation on the ink holding chamber to increase the flow of ink to a distal part of the ink holding chamber relative to the flow of ink to a proximal part of the ink holding chamber.

23 Claims, 12 Drawing Sheets

INTRODUCING INK INTO AN INK CARTRIDGE

CROSS REFERENCE TO RELATED APPLICATIONS

This is a continuation-in-part of U.S. application Ser. No. 11/589,526 filed Oct. 30, 2006 entitled Introducing Ink Into An Ink Cartridge.

BACKGROUND

Refill kiosks are becoming popular with printer users for refilling used inkjet print cartridges. Inkjet print cartridges are also sometimes called ink cartridges, inkjet cartridges or ink pens. Factors affecting the performance and use of a refill kiosk include the degree to which the refill process can be automated (i.e., the labor required to refill the cartridge), the time it takes to refill the cartridge and the risk of overfilling the cartridge. The elongated form factor of comparatively long ink cartridges can make it difficult to refill such cartridges because the ink chamber extends further away from the nozzles.

DRAWINGS

Figure 9:
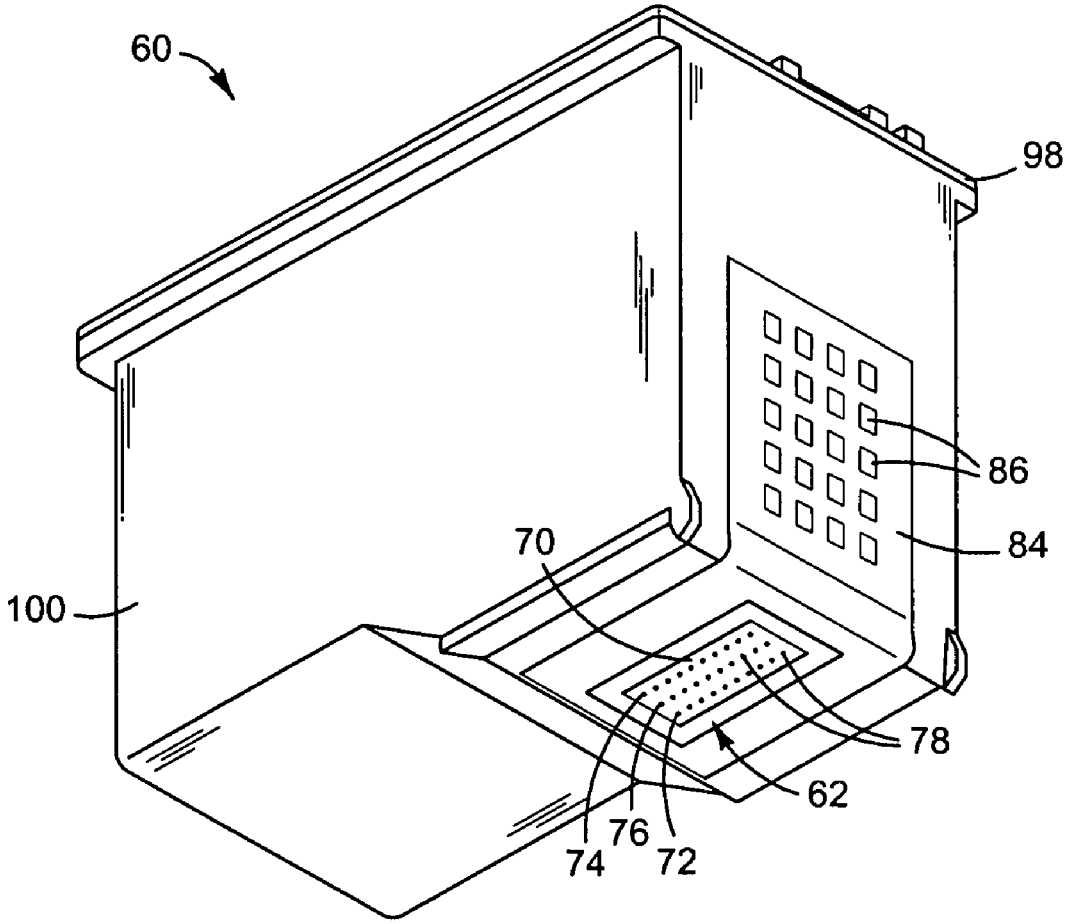
FIG. 9 is a perspective view illustrating a three-color ink cartridge.
Figure 11:
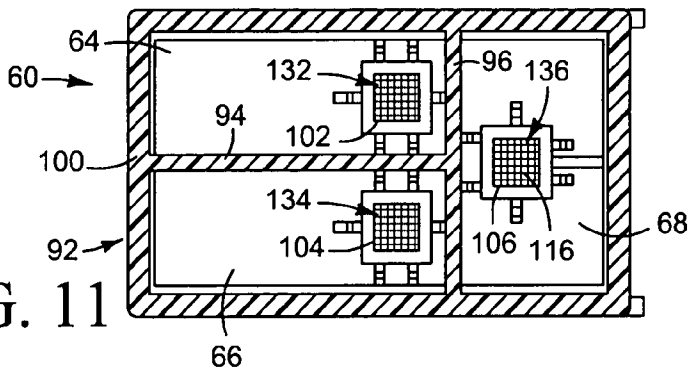
FIG. 11 is a plan section view of the ink cartridge of FIG. 9 taken along the line 11-11 in FIG. 12 with the ink holding foam omitted to more clearly illustrate some of the internal features of the ink cartridge
Figure 14:
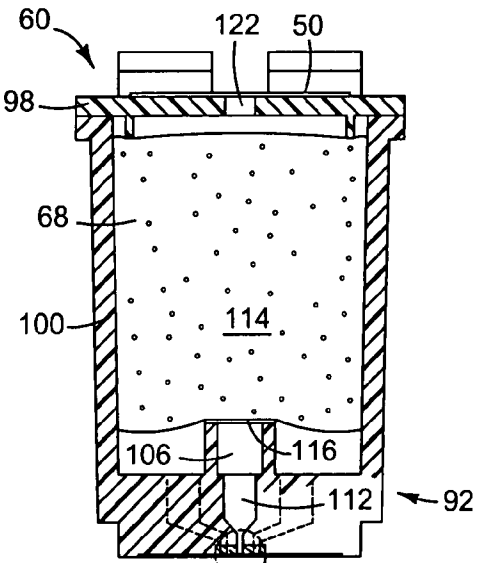
Figure 13:
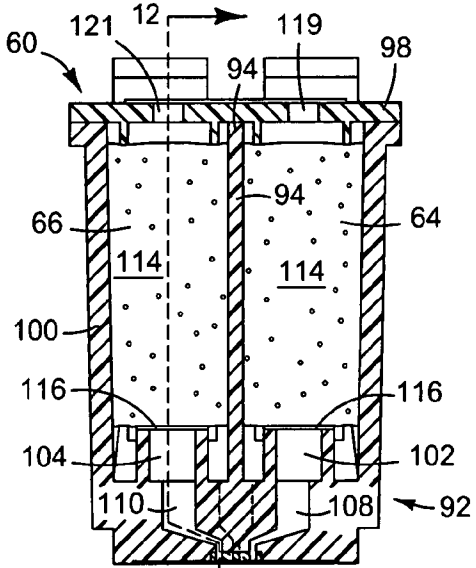
Figure 12:
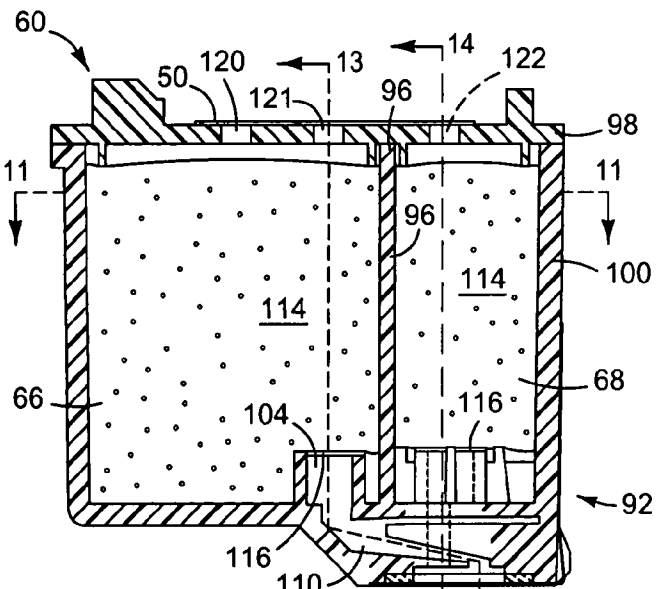
FIG. 12 is a side elevation section view of the cartridge of FIG. 9 taken along the line 12-12 in FIG. 13.

FIGS. 13 and 14 are front elevation section views of the ink cartridge of FIG. 9 taken along the lines 13-13 and 14-14 in FIG. 12.

Figure 15:
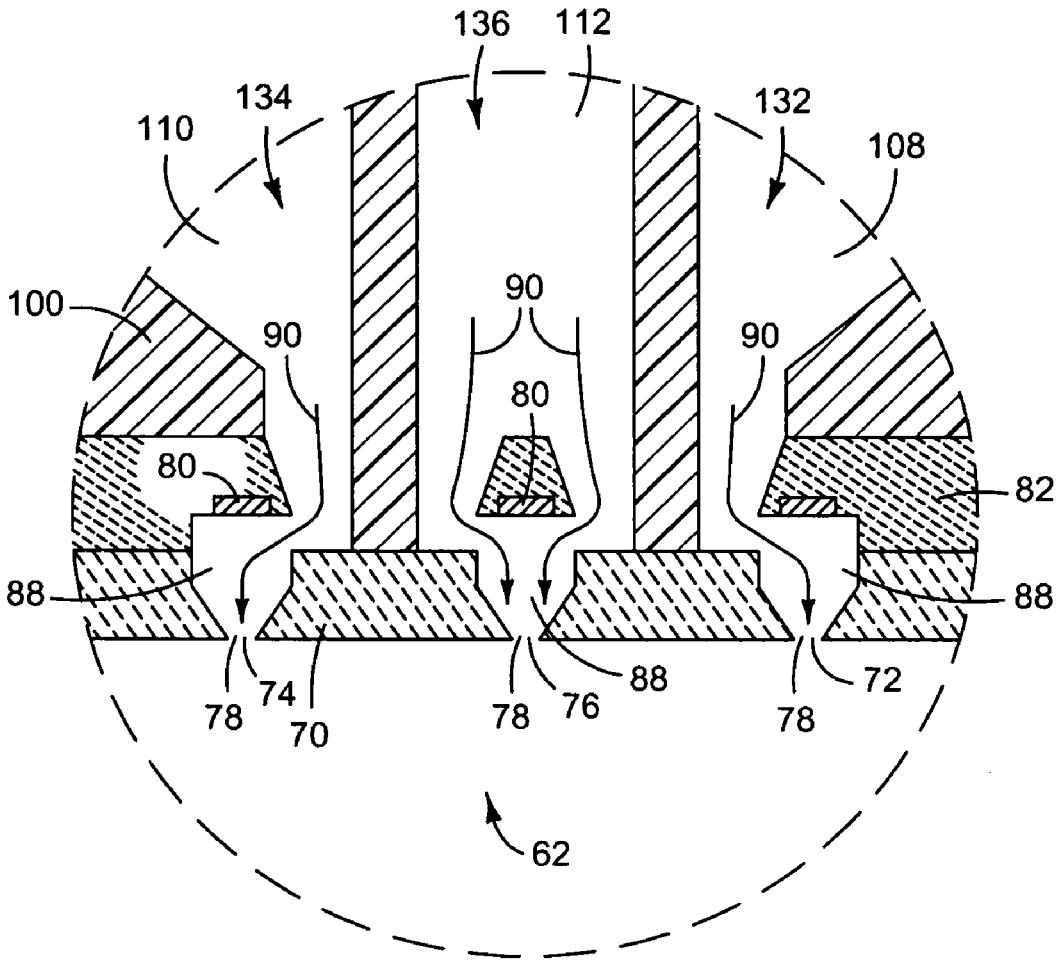

FIG. 15 is a detail section view taken from FIG. 14 of a portion of the printhead in the cartridge of FIG. 9.

Figure 17:
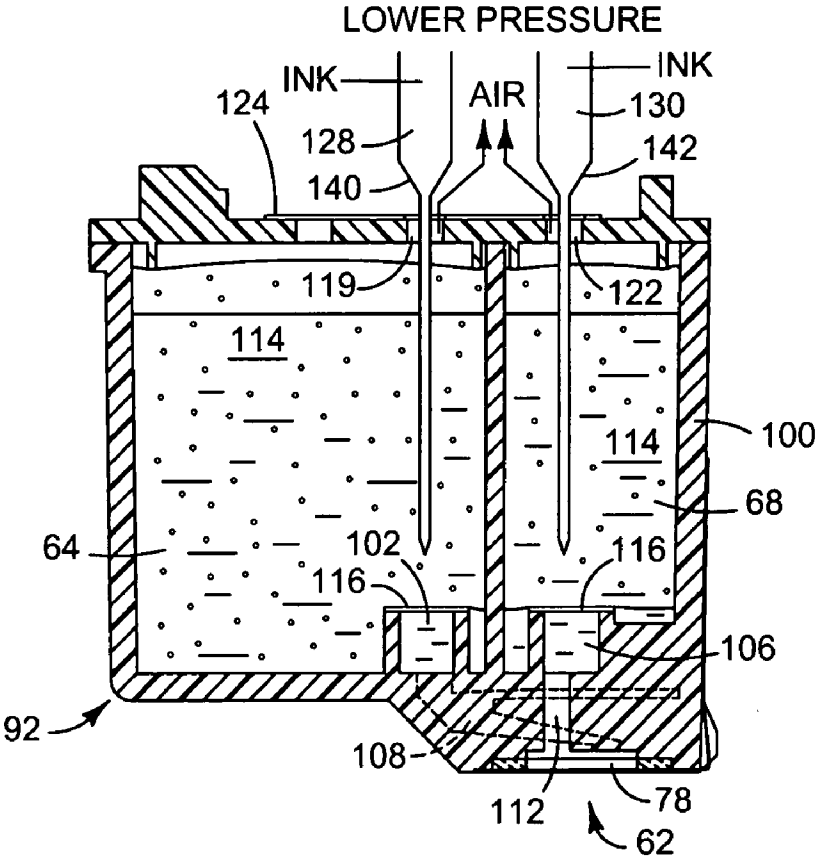
Figure 16:
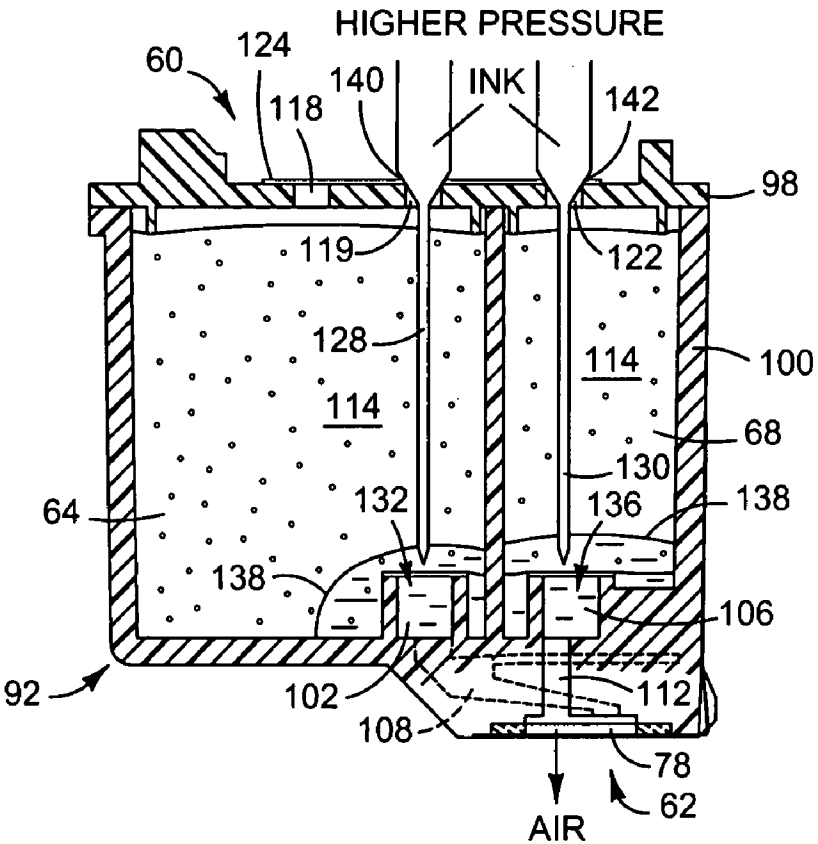

FIGS. 16 and 17 are side elevation section views of the cartridge of FIG. 9 illustrating a method according to an embodiment of the invention.

Figure 18:
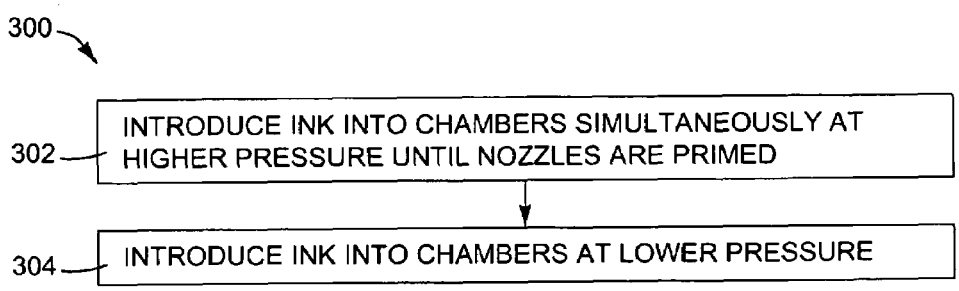

FIG. 18 is a flow chart illustrating an ink introduction method according to an embodiment of the invention.

Figure 19:
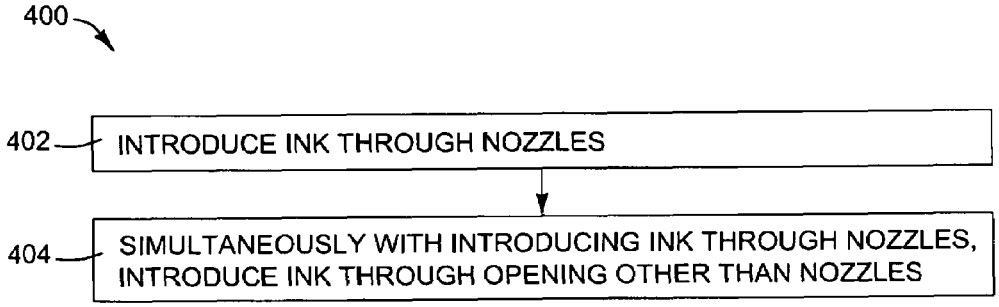

FIG. 19 is a flow chart illustrating an ink introduction method according to an embodiment of the invention.

Figure 1:
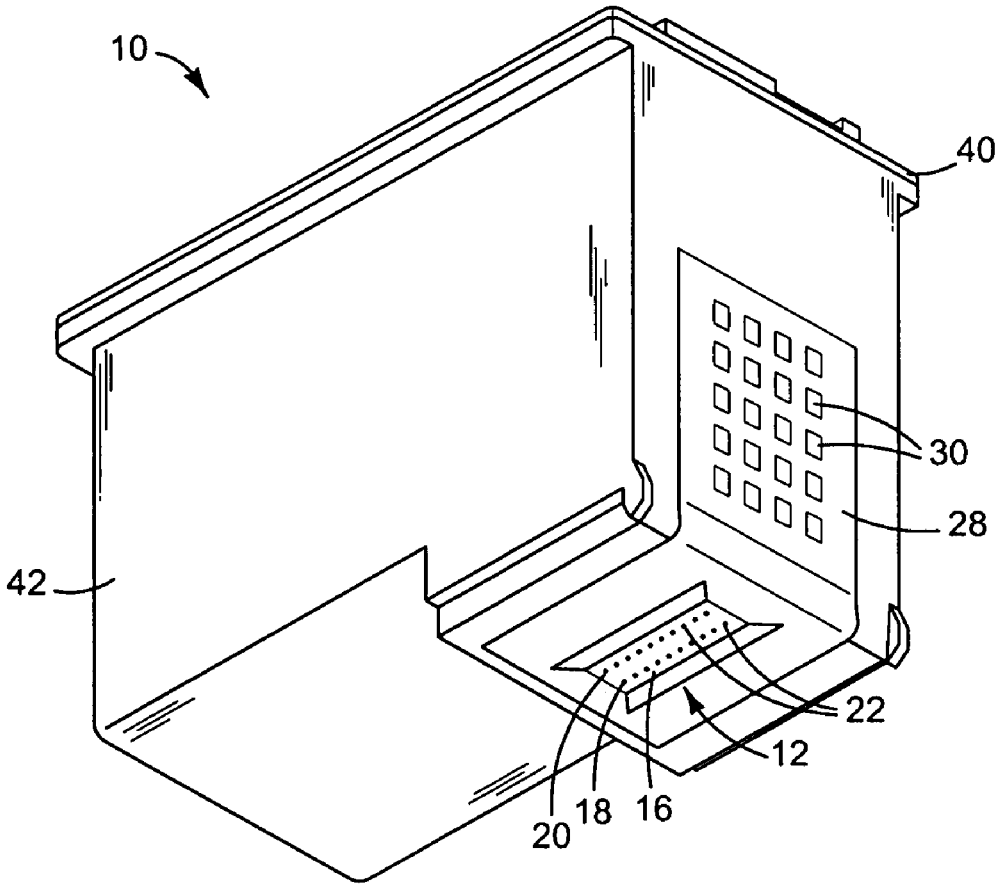
FIG. 1 is a perspective view illustrating a black or other single-color ink cartridge.
Figure 20:
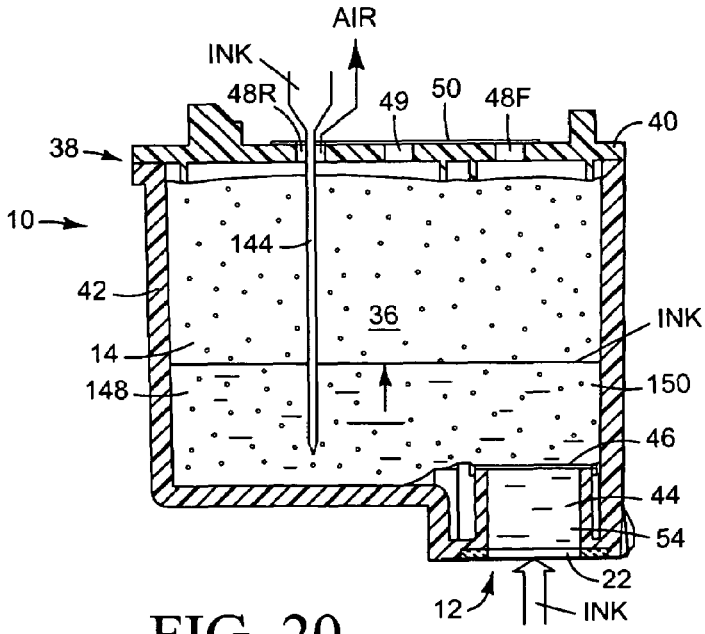

FIG. 20 is a side elevation section view of the cartridge of FIG. 1 illustrating a method according to an embodiment of the invention.

Figure 21:
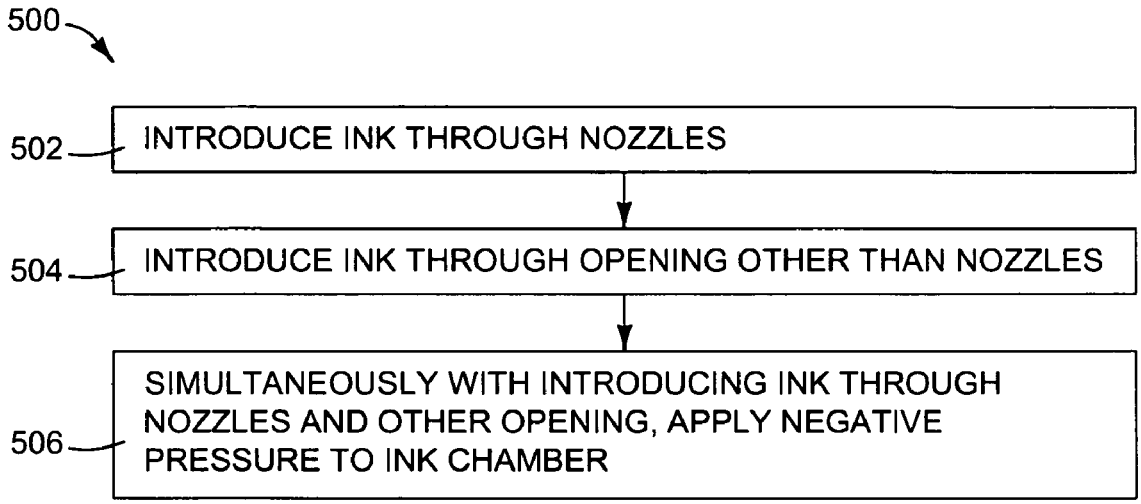

FIG. 21 is a flow chart illustrating an ink introduction method according to an embodiment of the invention.

Figure 22:
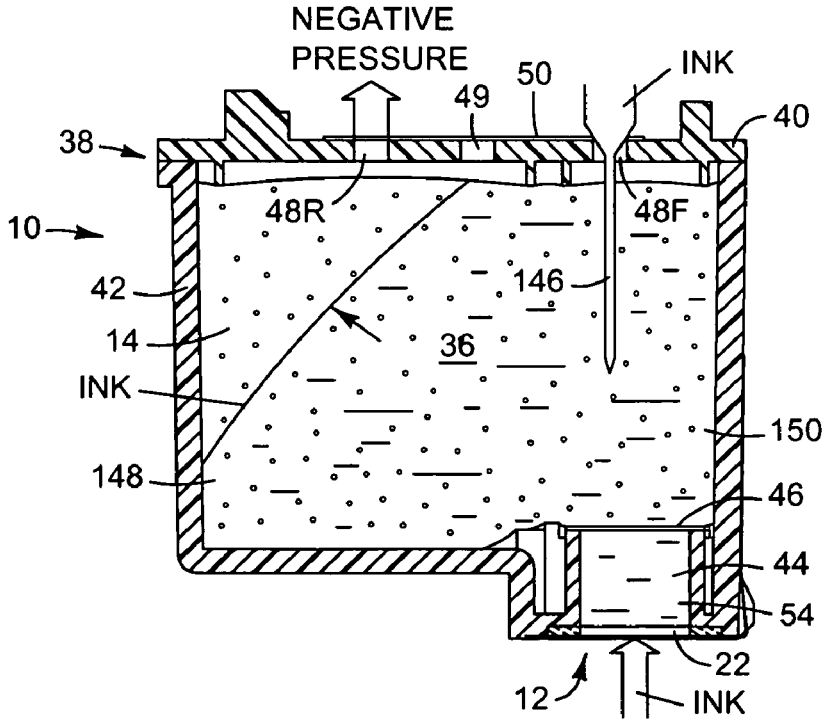

FIG. 22 is a side elevation section view of the cartridge of FIG. 1 illustrating a method according to an embodiment of the invention.

Figure 23:
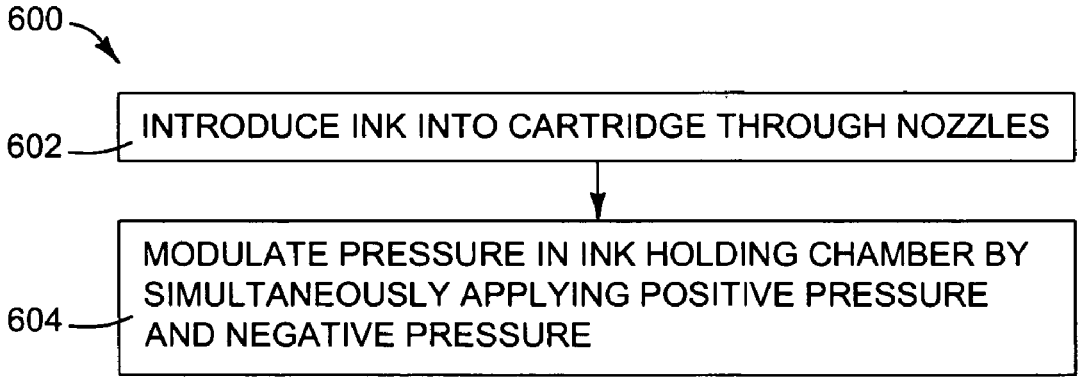

FIG. 23 is a flow chart illustrating an ink introduction method according to an embodiment of the invention.

Figure 24:
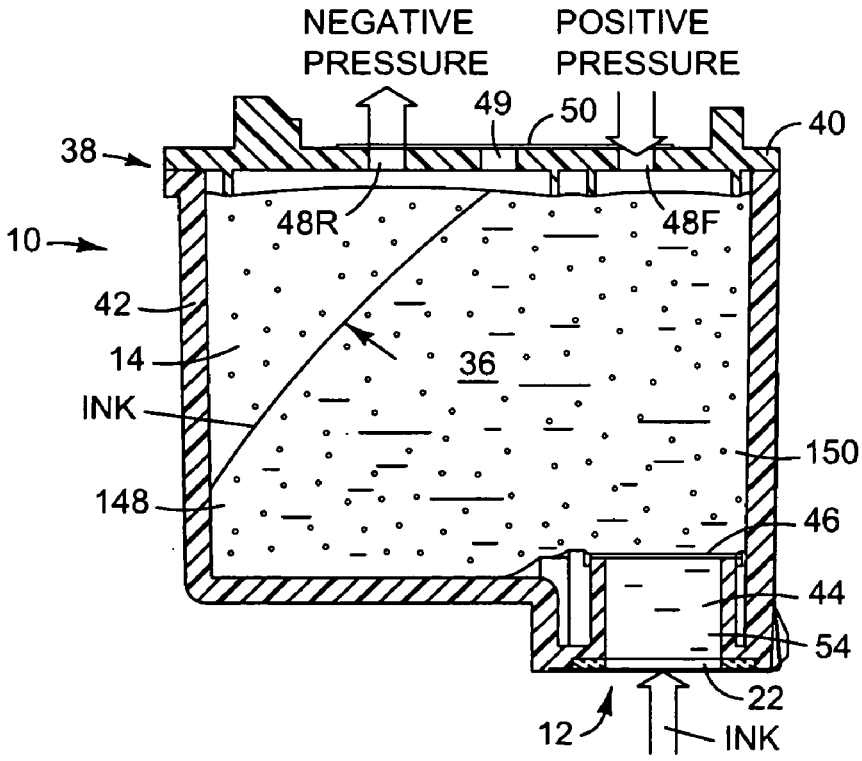

FIG. 24 is a side elevation section view of the cartridge of FIG. 1 illustrating a method according to an embodiment of the invention.

Figure 25:
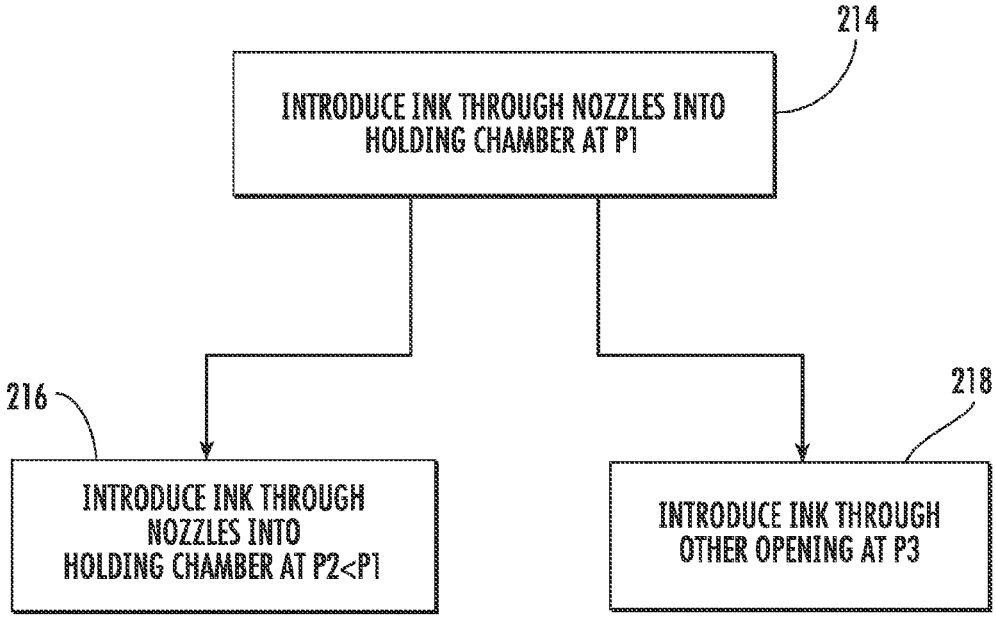

FIG. 25 is a flow chart illustrating another ink introduction method according to an example embodiment.

DETAILED DESCRIPTION

Embodiments of the new methods were developed in an effort to improve on conventional kiosk ink cartridge refill methods for longer ink cartridges. Embodiments will be described, therefore, with regard to refilling a used ink cartridge. Embodiments of the new methods for introducing ink into an ink cartridge, however, are not limited to use in refill kiosks, or for refilling used cartridges generally, but may also be used in any environment or application in which it might be desirable to use the new methods.

Figure 2:
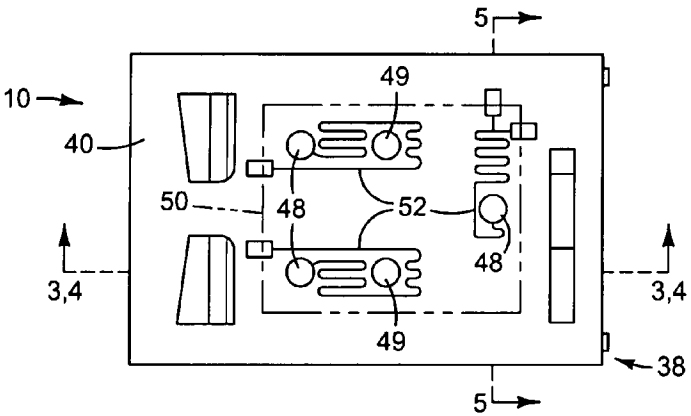
FIG. 2 is a top plan view of the ink cartridge of FIG. 1.
Figure 7:
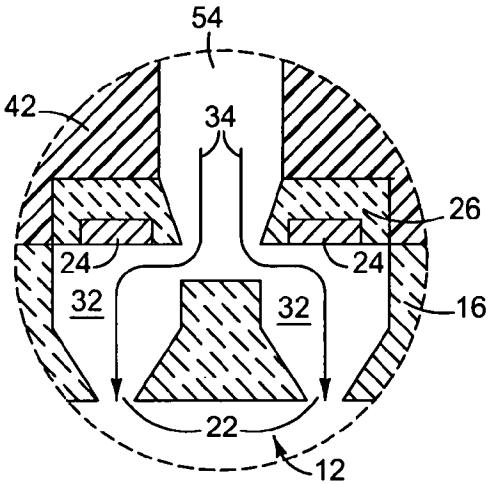
FIG. 7 is a detail section view taken from FIG. 5 of a portion of the printhead in the cartridge of FIG. 1.
Figure 5:
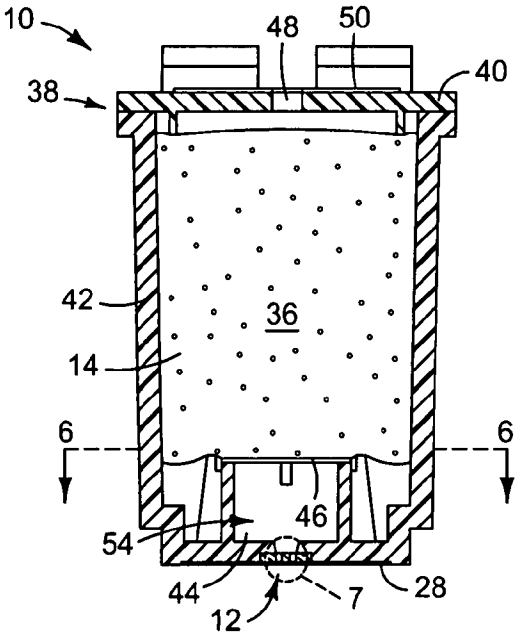
FIG. 5 is a front elevation section view of the ink cartridge of FIG. 1 taken along the line 5-5 in FIG. 2.

FIGS. 1-7 illustrate a single-color (typically black) ink cartridge 10 for a thermal inkjet printer. Embodiments of the invention might also be implemented with respect to an ink cartridge for a piezoelectric inkjet printer or any other inkjet printer in which it might be desirable to use the new methods. FIG. 1 is a perspective view of cartridge 10. FIG. 2 is a top plan view and FIGS. 3-6 are section views, respectively, of ink cartridge 10. The ink holding foam is cut-away in the top plan section view of FIG. 6 to more clearly illustrate some of the internal features of ink cartridge 10. FIG. 7 is a detail section view of a portion of the printhead in cartridge 10.

Referring to FIGS. 1-7, cartridge 10 includes a printhead 12 located at the bottom of cartridge 10 below an ink holding chamber 14. Printhead 12 includes a nozzle plate 16 with two arrays 18, 20 of ink ejection nozzles 22. In the embodiment shown, each array 18, 20 is a single row of nozzles 22. As shown in the detail view of FIG. 7, firing resistors 24 formed on an integrated circuit chip 26 are positioned behind ink ejection nozzles 22. A flexible circuit 28 carries electrical traces from external contact pads 30 to firing resistors 24. When ink cartridge 10 is installed in a printer, cartridge 10 is electrically connected to the printer controller through contact pads 30. In operation, the printer controller selectively energizes firing resistors 24 through the signal traces in flexible circuit 28. When a firing resistor 24 is energized, ink in a vaporization chamber 32 (FIG. 7) next to a resistor 24 is vaporized, ejecting a droplet of ink through a nozzle 22 on to the print media. The low pressure created by ejection of the ink droplet and cooling of chamber 32 then draws in ink to refill vaporization chamber 32 in preparation for the next ejection. The flow of ink through printhead 12 is illustrated by arrows 34 in FIG. 7.

Ink is held in foam 36 or another suitable porous material in ink chamber 14 formed within a cartridge housing 38. Housing 38, which is typically molded plastic, may be molded as a single unit, molded as two parts (e.g., a cover 40 and a body 42) or constructed of any number of separate parts fastened to one another in the desired configuration. An outlet 44 to printhead 12 is located near the bottom of ink chamber 14. A filter 46 covering outlet 44 is often used to keep contaminants, air bubbles and ink flow surges from entering printhead 12 during operation. Foam 36 is usually compressed around filter 46 and outlet 44 to increase its capillarity in the region of outlet 44. As ink is depleted from foam 36, the increased capillarity near outlet 44 tends to draw ink from all other portions of foam 36 to maximize the amount of ink drawn from chamber 14.

Referring now specifically to FIG. 2, openings 48 and 49 formed in cover 40 are covered by a label or other suitable adhesive sheet 50. Vent openings 48 are exposed to the atmosphere through circuitous tunnels 52. Each tunnel 52, commonly referred to as a labyrinth, is formed by a recess in the top of cover 40 that extends past the edge of label 50. Labyrinths, which are well known in the art of inkjet printing, are commonly used for venting ink cartridges to slow the rate of evaporation.

Figure 8A:
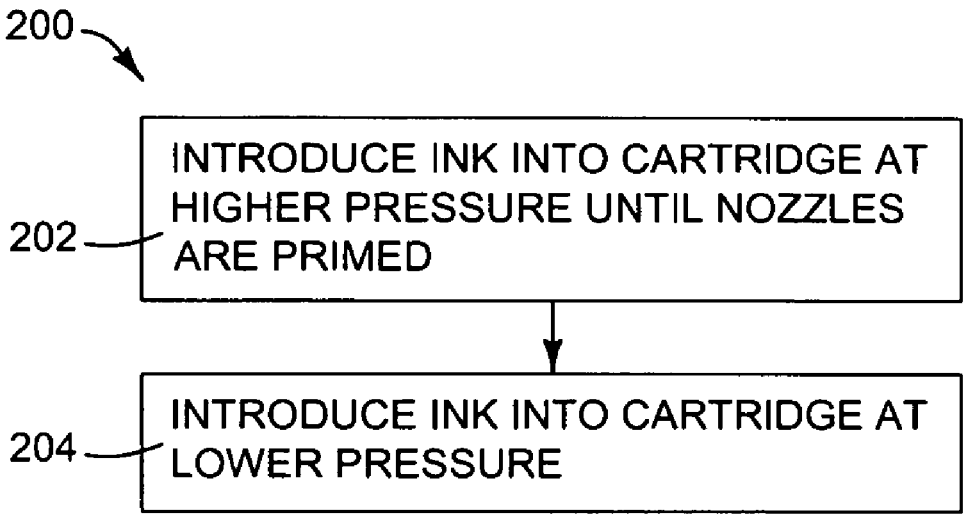
FIGS. 8A and 8B are a flow chart and graph, respectively, illustrating an ink introduction method according to an embodiment of the invention.
Figure 8B:
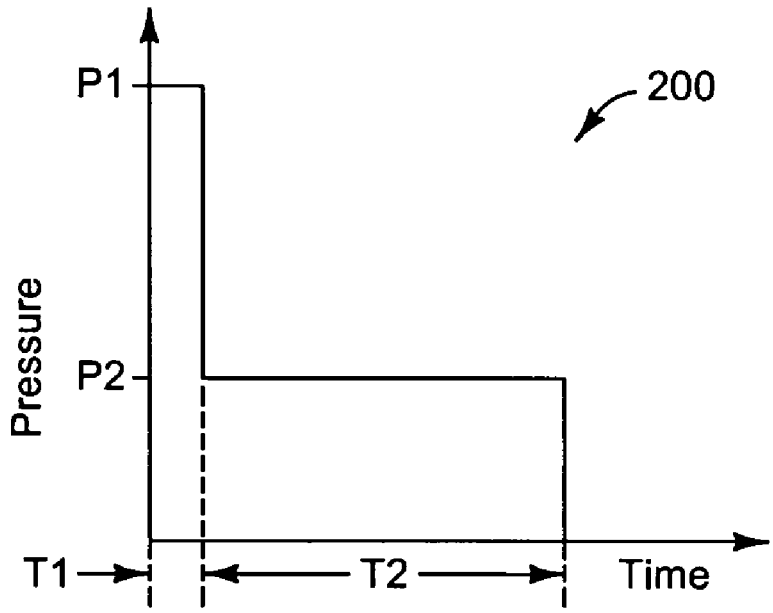

FIGS. 8A and 8B depict an ink introduction method 200 according to one embodiment of the invention. Method 200 will be described with reference to the single color ink cartridge 10 shown in FIGS. 1-7. Referring to FIGS. 8A and 8B, ink is introduced into cartridge 10 through nozzles 22 at a first higher ink pressure P1 (step 202) for a first duration T1 and then at a second lower ink pressure P2 for a second duration T2 (step 204). First pressure P1 and time T1 are selected to enable ink to displace air from printhead 12. The desired pressure P1 and duration T1 for a particular application can be determined routinely by testing a range of applied pressures and durations until a desired air displacement is achieved. Printhead geometry, nozzle diameter, ink viscosity, and surface tension, for example, are factors that may influence the desired pressure P1 and duration T1. In one exemplary embodiment for refilling a used print cartridge, pressure P1 should be sufficient to overcome surface tension forces within cartridge 10 to displace air from the wetted portions of printhead 12. While the actual pressure P1 may vary according to the factors noted above, a pressure P1 of about 3 psi is expected to be sufficient in smaller monochrome print cartridges such as an HP 56 black ink cartridge.

Figure 3:
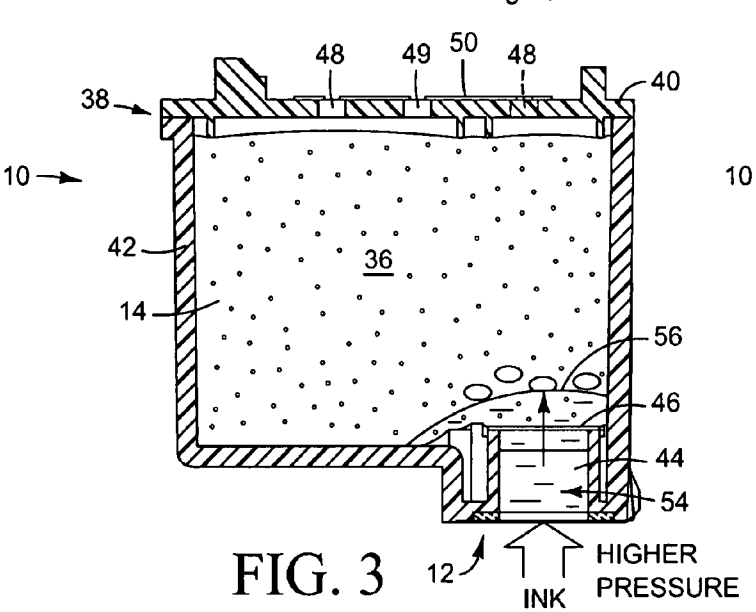
Figure 6:
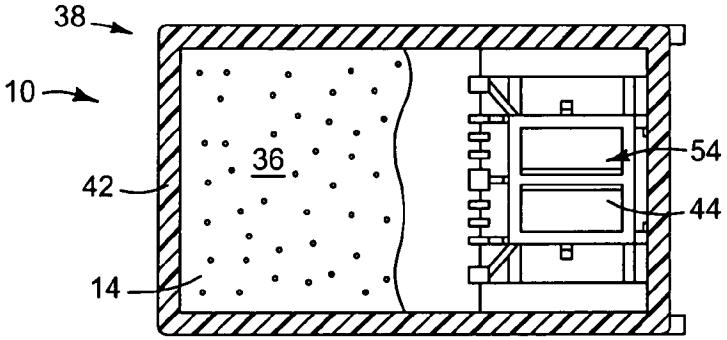
FIG. 6 is a plan section view of the ink cartridge of FIG. 1 taken along the line 6-6 in FIG. 5 with the ink holding foam cut-away to more clearly illustrate some of the internal features of the ink cartridge.

In one exemplary embodiment for introducing ink into a cartridge 10, ink is introduced into cartridge 10 at the higher pressure P1 at least until nozzles 22 are primed with ink and, optionally, until ink fills ink delivery area 54 (FIGS. 3-7) and reaches the bottom of ink chamber 14 and foam 36, as shown by ink level 56 in FIG. 3. Ink delivery area 54 designates the structure between ink chamber 14 and nozzles 22 through which ink can move between chamber 14 and nozzles 22. "Prime" as used in this document means displacing sufficient air from the ink chamber, ink delivery area, nozzles and/or other regions of the printhead in a cartridge such that any remaining air bubbles will not degrade print quality. Nozzles 22 in cartridge 10 are primed, therefore, when ink has displaced sufficient air from the operative portions of printhead 12 such that any remaining air will not degrade print quality for cartridge 10. Although FIG. 8B depicts constant pressure P1 throughout duration T1, pressure P1 may vary over time as long as it is sufficient to prime nozzles 22 as described above.

Figure 4:
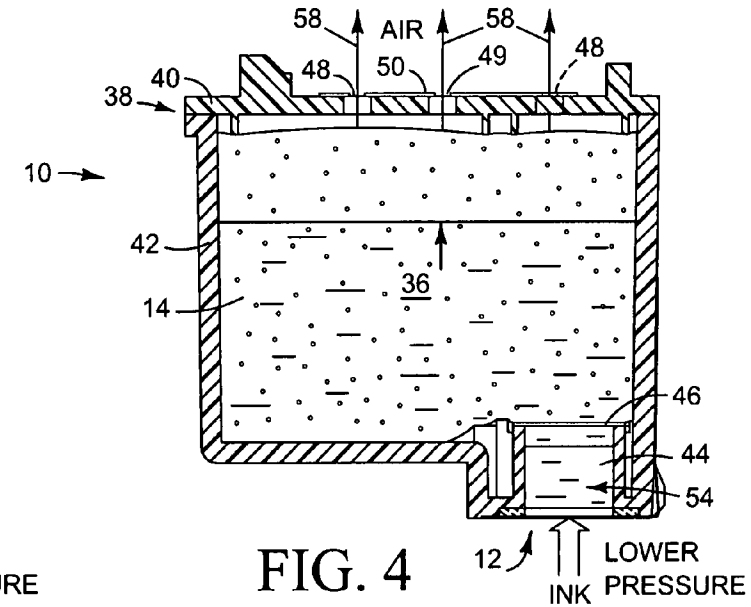
FIGS. 3 and 4 are side elevation section views of the cartridge of FIG. 1 taken along the line 3/4-3/4 in FIG. 2.

Referring again to FIGS. 8A and 8B, following step 202, the applied pressure is reduced to a lower pressure P2 for duration T2 in step 204 until the ink reaches the desired fill level. As shown in FIG. 4, introducing ink into cartridge 10 at a lower pressure P2 helps allow the ink to wick fully into foam 36 without overflowing through openings 48 and 49. It is desirable, therefore, that the second pressure P2 is low enough so that ink introduced into cartridge 10 will saturate substantially all of foam 36 before overflowing ink chamber 14. Although FIG. 8B depicts constant pressure P2 throughout duration T2, pressure P2 may vary over time. Therefore, "pressure" as used in this document means a single pressure applied over a duration of time, a range of pressures applied over the duration, a peak pressure applied over the duration, or an average of varying pressures applied over the duration. For refilling a typical monochrome ink cartridge such as cartridge 10, it is expected that higher pressure P1 in step 202 (or the peak pressure applied in step 202 if a variable pressure) will be at least 50% greater than lower pressure P2 in step 204 (or the average pressure applied in step 204 if a variable pressure). Optionally, higher pressure P1 in step 202 (or the peak pressure applied in step 202 if a variable pressure) is more than twice the lower pressure P2 in step 204 (or the average pressure applied in step 204 if a variable pressure). While the duration T2 of lower pressure step 204 will tend to be greater than the duration T1 of higher pressure step 202, it is expected that the total time for both steps (T1+T2) for a typical cartridge 10 will usually be less than 30 seconds. The two stage method illustrated in FIGS. 8A and 8B helps achieve the dual purposes of removing substantially all of the air from printhead 12 while also allowing for complete filling of ink chamber 14 without also overflowing chamber 14. The new two stage method is particularly advantageous for refilling cartridges that utilize a foam or other wicking agent (e.g., ink holding foam 36) and have a long form factor (i.e., elongated from side to side).

For refilling some used cartridges, it may be desirable to puncture or remove label 50 to expose chamber 14 directly to the atmosphere through openings 48 and 49. While it is expected that label 50 covering all five openings 48 and 49 will be punctured or removed to expose chamber 14 directly to the atmosphere through all openings 48 and 49, as shown in FIGS. 3 and 4, it may be desirable under some circumstances to expose chamber 14 directly to the atmosphere through fewer than all of openings 48 and 49, or to not expose chamber 14 directly to the atmosphere at all (relying on the slow venting through labyrinths 52). Exposing one or more vents 48 directly to the atmosphere allows air to escape ink chamber 14 faster as indicated by arrows 58 in FIG. 4 and may, therefore, allow ink to fill chamber 14 faster.

Figure 10:
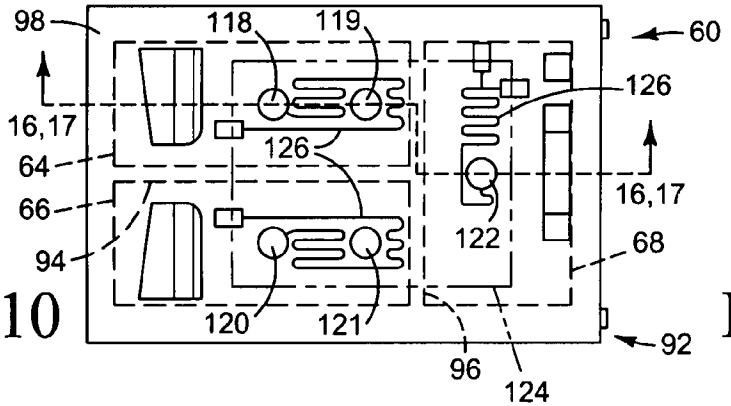
FIG. 10 is a top plan view of the ink cartridge of FIG. 9.

FIGS. 9-15 illustrate a three color ink cartridge 60 for a thermal inkjet printer. FIG. 9 is a perspective view of cartridge 60. FIG. 10 is a top plan view and FIGS. 11-14 are section views, respectively, of ink cartridge 60. The ink holding foam is omitted from the top plan section view of FIG. 11 to more clearly illustrate some of the internal features of ink cartridge 60. FIG. 15 is a detail section view of a portion of the printhead in cartridge 60. Referring to FIGS. 9-15, cartridge 60 includes a printhead 62 located at the bottom of cartridge 60 below ink chambers 64, 66 and 68. Printhead 62 includes a nozzle plate 70 with three arrays 72, 74 and 76 of ink ejection nozzles 78. In the embodiment shown, each array 72, 74 and 76 is a single row of nozzles 78. As shown in FIG. 15, firing resistors 80 formed on an integrated circuit chip 82 are positioned behind ink ejection nozzles 78. A flexible circuit 84 carries electrical traces from external contact pads 86 to firing resistors 80.

When ink cartridge 60 is installed in a printer, cartridge 60 is electrically connected to the printer controller through contact pads 86. In operation, the printer controller selectively energizes firing resistors 80 through the signal traces in flexible circuit 84. When a firing resistor 80 is energized, ink in a vaporization chamber 88 (FIG. 15) next to a resistor 80 is vaporized, ejecting a droplet of ink through nozzle 78 on to the print media. The low pressure created by ejection of the ink droplet and cooling of chamber 88 then draws in ink to refill vaporization chamber 88 in preparation for the next ejection. The flow of ink through printhead 62 is illustrated by arrows 90 in FIG. 15.

Referring now to the section views of FIGS. 10-14, ink is stored in three chambers 64, 66 and 68 formed within cartridge housing 92. Each chamber 64, 66 and 68 may be used to store a different color ink, cyan, magenta and yellow for example. Ink chambers 64, 66 and 68 are separated from one another by partitions 94 and 96. Housing 92, which is typically formed from a plastic material, may be molded as a single unit, molded as two parts (e.g., a cover 98 and a body 100 that includes partitions 94 and 96) or constructed of any number of separate parts fastened to one another in the desired configuration. An outlet 102, 104 and 106 is located near the bottom of each ink chamber 64, 66 and 68, respectively. A conduit 108, 110 and 112 leads from each outlet 102, 104 and 106, respectively. Ink passes from each chamber 64, 66 or 68 through a corresponding outlet 102, 104 or 106 and conduit 108, 110 or 112 to printhead 62, where it is ejected through the corresponding nozzle array 72, 74 or 76, as described above.

Ink is held in foam 114 or another suitable porous material in each ink chamber 64, 66 and 68. A filter 116 covering each outlet 102, 104, and 106 is typically used to keep contaminants, air bubbles and ink flow surges from entering printhead 12 during operation. Foam 114 is usually compressed around filters 116 and outlets 102, 104 and 106 to increase its capillarity in the region of outlets 102, 104 and 106. As ink is depleted from foam 114, the increased capillarity near the outlet tends to draw ink from all other portions of foam 114 to maximize the amount of ink drawn from each chamber 64, 66 and 68.

Referring now specifically to FIG. 10, openings 118, 119, 120, 121 and 122 formed in cover 98 are covered by a label or other suitable adhesive sheet 124. Vent openings 118, 120 and 122 are exposed to the atmosphere through circuitous tunnels 126. Each tunnel 126, commonly referred to as a labyrinth, is formed by a recess in the top of cover 98 that extends past the edge of label 124.

FIG. 18 is a flow chart illustrating an ink introduction method 300 according to one embodiment of the invention. Method 300 will be described with reference to ink cartridge 60 shown in FIGS. 16-17. FIGS. 16-17 are side elevation section views of cartridge 60, similar to FIG. 12, showing ink fill needles 128 and 130. The cross-hatching has been partly removed from the area of conduit 108 in FIG. 16 to better illustrate this area of cartridge 60. Referring first to FIGS. 16 and 18, in step 302, ink is introduced into each ink chamber 64, 66 and 68 simultaneously through a set of three ink fill needles. Only two of the three ink fill needles (needles 128 and 130) are visible in the side view of FIGS. 16-17. Hence, the following description calls out only those parts visible in FIGS. 16-17. It is to be understood, however, that the same actions are performed simultaneously in the ink chamber 66 that is not visible in FIGS. 16-17.

A first higher ink pressure stage of a filling method is depicted in step 302 of method 300 in FIG. 18 and as pressure P1 in FIG. 8B. During step 302, ink chambers 64 and 68 are sealed so that the ink pushes substantially all of the air out of printhead 62 through nozzles 78. For example, if ink flow needles are used as shown in FIG. 16, then once cartridge 60 is placed in the fill/refill device the ink flow needles 128 and 130 are inserted into openings 119 and 122 as shown until a stopper 140, 142 on each needle 128 and 130 contacts and seals each opening 119 and 122. Ink may be introduced into the bottom of each chamber 64 and 68 near outlets 102 and 106, as shown in FIG. 16, to help push air out through nozzles 78. Although the position of the ink fill needles may vary depending on the particular configuration of the ink cartridge, it is expected that positioning the end of each needle 128 and 130 between 1.0 mm and 5.0 mm from filters 116 will more effectively push air out through nozzles 78 for configurations like those of cartridge 60. Ink is introduced into each chamber 64 and 68 at the higher pressure at least until air is displaced through nozzles 78 and, optionally, until nozzles 78 are primed with ink. It may also be desirable to continue at the higher pressure P1 until ink fills ink delivery areas 132, 134 and 136 and reaches the bottom of each ink chamber, as shown by ink level 138 in FIG. 16. Each ink delivery area 132, 134 and 136, shown in FIG. 11, designates the structure between each ink chamber 64, 66 and 68 and nozzle array 72, 74 and 76 through which ink can move between the ink chambers and the nozzles.

"Seal" as used in this document does not mean completely sealed—all that is necessary is that sufficient pressure can develop in each chamber 64, 66 and 68 during the introduction of ink to push any air trapped in ink delivery areas 132, 134 and 136 out through nozzles 78. For example, although a labyrinth 126 (FIG. 10) is connected to rear vent openings 118 and 120, the release of air through labyrinths 126 may be slow enough that sufficient pressure might still be developed in chambers 64 and 66 at the higher rate of ink flow to push air out of ink delivery areas 132 and 134 through nozzles 78. As noted above, "prime" as used in this document means displacing sufficient air from the ink chamber, ink delivery area, nozzles and/or other regions of the printhead in a cartridge such that any remaining air bubbles will not degrade print quality. Nozzles 78 in cartridge 60 are primed, therefore, when ink has displaced sufficient air from the operative portions of printhead 62 such that any remaining air will not degrade print quality for cartridge 60. Nozzles 78 are primed, therefore, when ink has displaced sufficient air from the operative portions of printhead 62 such that any remaining air will not degrade print quality for cartridge 60.

Referring now to FIGS. 17 and 18, once air has been displaced through nozzles 78, the applied pressure of ink is reduced as depicted in step 304 and as lower pressure P2 in FIG. 8B. Optionally, ink chambers 64 and 68 are unsealed by, for example, partially withdrawing ink needles 128 and 130 as shown in FIG. 17, and the flow of ink is decreased to a second lower rate in step 304 until the ink reaches the desired fill level. As shown in FIG. 17, introducing ink into chambers 64 and 68 at a lower rate of flow helps allow the ink to wick fully into foam 114 without overflowing through openings 119 and 122. It is desirable, therefore, that the second rate of flow is low enough so that ink introduced into chambers 64 and 68 will saturate substantially all of foam 114 before overflowing chambers 64 and 68. The two stage method illustrated in FIG. 18 helps enable fully automated kiosk refill processing for multi-color ink cartridges while still effectively purging air from the printhead to fully prime the nozzles during the refill method.

In an alternative fill method (not shown), each chamber 64, 66 and 68 is filled separately, allowing the use of just one needle if desired.

FIG. 19 is a flow chart illustrating a method 400 for introducing ink into a cartridge such as single-color cartridge 10 shown in FIGS. 1-7. The method of FIG. 19 will be described with reference to ink cartridge 10 shown in FIG. 20. FIG. 20 is a side elevation section view of cartridge 10, similar to FIG. 3, showing an ink fill needle 144 inserted into rear vent 48R. Referring to FIGS. 19 and 20, in step 402, ink is introduced into cartridge 10 through nozzles 22. In step 404, ink is introduced into cartridge 10 through one or more of openings 48R, 48F, and 49 using an ink fill needle 144 or other suitable conveyance. In the embodiment shown in FIG. 20, ink is introduced into cartridge 10 in step 404 through a rear vent 48R. Although ink may be introduced through any one or more of openings 48R, 48F, and 49 in step 404, it may be desirable in some applications to introduce ink through one or more of the openings positioned further away from the nozzles, such as rear vents 48R in FIG. 20, to help balance the flow of ink into chamber 14 and, accordingly, allow ink to flow more uniformly into chamber 14. For convenience, only rear vent 48R is referenced in the following description for introducing ink in step 404 even though, as noted above, any one or more of openings 48R, 48F, and 49 may be used.

Ink is introduced into cartridge 10 through nozzles 22 (step 402) and vent 48R (step 404) simultaneously throughout some or all of the time to fill/refill cartridge 10. The duration for which ink is introduced simultaneously through nozzles 22 and vent 48R may vary depending on the particular fill or refill operation. In general, however, it is expected that the simultaneous introduction of ink will run throughout most of the fill operation. It may be desirable in some applications to delay the introduction of ink through vent 48R, so that air may be more easily displaced from printhead 12, until nozzles 22 are primed with ink introduced through nozzles 22 and, optionally, until ink introduced through nozzles 22 fills ink delivery area 54 and reaches the bottom of ink chamber 14 and foam 36, as shown by ink level 56 in FIG. 3. Then, the flow of ink through vent 48R may be started to complete filling chamber 14 with ink introduced through both nozzles 22 and vent 48R. A dual pressure method such as that described above with reference to FIGS. 8A and 8B may also be used. For example, as shown by step 214 in FIG. 25, ink may be introduced first through only nozzles 22 at a higher ink pressure P1 until ink reaches the bottom of chamber 14 (or at least until nozzles 22 are primed), and then, as shown by steps 216 and 218 in FIG. 25, continuing to introduce ink into chamber 14 through both nozzles 22 and vent 48R at lower pressures P2 and P3, respectively. According to one embodiment, pressures P2 and P3 are equal.

FIG. 21 is a flow chart illustrating a method 500 for introducing ink into a cartridge such as single-color cartridge 10 shown in FIGS. 1-7. The method of FIG. 21 will be described with reference to ink cartridge 10 shown in FIG. 22. FIG. 22 is a side elevation section view of cartridge 10, similar to FIG. 3, showing an ink fill needle 146 inserted into a front vent 48F. Referring to FIGS. 21 and 22, in step 502, ink is introduced into cartridge 10 through nozzles 22. In step 504, ink is introduced into cartridge 10 through one or more of openings 48R, 48F and 49 using an ink fill needle 146 or other suitable conveyance. In step 506, a negative pressure is applied to one or more of openings 48R, 48F and 49 at the same time ink is introduced simultaneously through nozzles 22 and front vent 48F to help speed the flow of ink into chamber 14. In the embodiment shown in FIG. 22, ink is introduced into cartridge 10 in step 504 through front vent 48F and negative pressure is applied in step 506 to a rear vent 48R. Although any combination of openings 48R, 48F, and 49 may be used for introducing ink and applying negative pressure, it may be desirable in some applications to introduce ink through one or more of the openings positioned closer to nozzles 22, such as front 48F in FIG. 22, and to apply negative pressure to one or more of the openings further from nozzles 22, such as rear vents 48R, to help distribute the flow of ink more uniformly throughout ink holding foam 36.

FIG. 23 is a flow chart illustrating a method 600 for introducing ink into a cartridge such as single-color cartridge 10 shown in FIGS. 1-7. The method of FIG. 23 will be described with reference to ink cartridge 10 shown in FIG. 24. FIG. 24 is a side elevation section view of cartridge 10, similar to FIG. 3, showing pressure modulation at front and rear vents 48F and 48R. Referring to FIGS. 23 and 24, in step 602, ink is introduced into cartridge 10 through nozzles 22. In step 604, the pressure in chamber 14 is modulated through the application of negative and positive pressures, respectively, at two or more of openings 48R, 48F, and 49. In the embodiment shown in FIG. 24, positive pressure is applied to front vent 48F while negative pressure is applied simultaneously to rear vent 48R while ink is introduced into cartridge 10 through nozzles 22. Although any combination of openings 48R, 48F, and 49 may be used for applying positive and negative pressures, one combination shown in FIG. 24 helps distribute more ink toward portions of ink holding foam 36 further from nozzles 22.

In the methods illustrated in FIGS. 19/20, 21/22 and 23/24, introducing ink through nozzles 22 (steps 402, 502 and 602) may be characterized as a primary operation performed on ink holding chamber 14 and each of the other acts (steps 404, 504-506 and 604) may be characterized as a secondary operation performed on ink holding chamber 14. In the embodiments shown and described, the secondary operation helps increase the flow of ink to the distal/rear part 148 of ink holding chamber 14 relative to the flow of ink to the proximal/front 150 of ink holding chamber 14. As used in this document, the "distal" or "rear" part of the ink holding chamber refers to that part of the chamber that is lengthwise more distant from the ink ejection nozzles and the "proximal" or "front" part of the ink holding chamber refers to that part of the chamber lengthwise nearer to the ink ejection nozzles.

The methods described above may also be used with multiple chamber cartridges, such as the three color ink cartridge shown in FIGS. 9-15, in which multiple inks are held in different chambers. However, introducing ink into multi-chambered cartridges through the nozzles is more difficult than for single chamber cartridges because each of the different chambers must be filled through the corresponding array of nozzles to avoid mixing the different color inks.

The present invention has been shown and described with reference to the foregoing exemplary embodiments. It is to be understood, however, that other forms, details and embodiments may be made without departing from the spirit and scope of the invention which is defined in the following claims.

What is claimed is:

1. A method for introducing ink into an ink cartridge having ink ejection nozzles and an ink holding chamber, the method comprising:

introducing ink into the ink holding chamber through the ink ejection nozzles; and simultaneously with introducing ink into the ink holding chamber through the ink ejection nozzles, introducing ink into the ink holding chamber through an opening other than the ink ejection nozzles or applying a negative pressure at a first opening to the ink holding chamber and applying a positive pressure at a second opening to the ink holding chamber.

2. The method of claim 1, wherein introducing ink into the ink holding chamber through an opening other than the ink ejection nozzles or applying a negative pressure at a first opening to the ink holding chamber and applying a positive pressure at a second opening to the ink holding chamber comprises introducing ink into the ink holding chamber through an opening other than the ink ejection nozzles.

3. The method of claim 1, wherein introducing ink into the ink holding chamber through an opening other than the ink ejection nozzles or applying a negative pressure at a first opening to the ink holding chamber and applying a positive pressure at a second opening to the ink holding chamber comprises applying a negative pressure at a first opening to the ink holding chamber and applying a positive pressure at a second opening to the ink holding chamber.

4. A method for introducing ink into an ink cartridge having ink ejection nozzles and an ink holding chamber, the method comprising:

introducing ink into the ink holding chamber through the ink ejection nozzles; and simultaneously with introducing ink into the ink holding chamber through the ink ejection nozzles, introducing ink into the ink holding chamber through an opening other than the ink ejection nozzles.

5. The method of claim 4, wherein the opening comprises an opening configured to vent the ink chamber.

6. The method of claim 4, wherein the opening comprises an opening in a cover of the cartridge.

7. The method of claim 4, wherein introducing ink into the ink holding chamber through an opening other than the ink ejection nozzles comprises introducing ink into the ink holding chamber through an opening other than the ink ejection nozzles only after the nozzles are primed with ink.

8. The method of claim 4, wherein introducing ink into the ink holding chamber through an opening other than the ink ejection nozzles comprises introducing ink into the ink holding chamber through an ink fill needle inserted through the opening into the ink holding chamber.

9. The method of claim 4, further comprising, simultaneously with introducing ink into the ink holding chamber through the ink ejection nozzles and through the opening, applying a negative pressure to the ink holding chamber through an opening to the ink holding chamber.

10. The method of claim 9, wherein the opening through which ink is introduced into the ink holding chamber and the opening through which a negative pressure is applied comprise the same opening.

11. The method of claim 9, wherein the opening through which ink is introduced into the ink holding chamber and the opening through which a negative pressure is applied comprise different openings.

12. A method for introducing ink into an ink cartridge having ink ejection nozzles and an ink holding chamber, the method comprising:

introducing ink into the ink holding chamber through the ink ejection nozzles;

simultaneously with introducing ink into the ink holding chamber through the ink ejection nozzles, applying a negative pressure at a first opening to the ink holding chamber and applying a positive pressure at a second opening to the ink holding chamber.

13. The method of claim 12, wherein the first opening and/or the second opening comprises an opening configured to vent the ink holding chamber.

14. The method of claim 12, wherein the first opening and/or the second opening comprises an opening in a cover of the cartridge.

15. The method of claim 12, further comprising, simultaneously with introducing ink into the ink holding chamber through the ink ejection nozzles and applying a negative pressure at the first opening and a positive pressure at the second opening, introducing ink into the ink holding chamber through an opening other than the ink ejection nozzles.

16. The method of claim 15, wherein the opening through which ink is introduced into the ink holding chamber and one of the first or second openings comprise the same opening.

17. A method for introducing ink into an ink cartridge having ink ejection nozzles and an ink holding chamber, the method comprising:

introducing ink into the ink holding chamber through the ink ejection nozzles at a first pressure; and then introducing ink into the ink holding chamber through the ink ejection nozzles at a second pressure lower than the first pressure; and simultaneously with introducing ink into the ink holding chamber through the ink ejection nozzles at the second pressure, introducing ink into the ink holding chamber through an opening other than the ink ejection nozzles.

18. The method of claim 17, wherein the cartridge includes a printhead operatively coupled to the ink holding chamber, the ink ejection nozzles included in the printhead, and the first pressure is sufficient to displace air from the printhead.

19. The method of claim 17, wherein:

introducing ink into the ink holding chamber through an opening other than the ink ejection nozzles comprises introducing ink into the ink holding chamber through an opening other than the ink ejection nozzles at a third pressure; and the cartridge includes an ink holding material in the ink holding chamber and the second pressure and the third pressures are low enough so that ink introduced into the chamber will saturate substantially all of the ink holding material before overflowing the chamber.

20. The method of claim 19, wherein the third pressure is substantially equal to the second pressure.

21. A method for introducing ink into an ink cartridge having ink ejection nozzles and an ink holding chamber, the method comprising:

performing a primary operation on the ink holding chamber by introducing ink into the ink holding chamber through the ink ejection nozzles; and performing a secondary operation on the ink holding chamber to increase the flow of ink to a distal part of the ink holding chamber relative to the flow of ink to a proximal part of the ink holding chamber, wherein the primary operation and the secondary operation are performed simultaneously, wherein performing a secondary operation on the ink holding chamber comprises introducing ink directly into the distal part of the ink holding chamber.

22. A method for introducing ink into an ink cartridge having ink ejection nozzles and an ink holding chamber, the method comprising:

performing a primary operation on the ink holding chamber by introducing ink into the ink holding chamber through the ink ejection nozzles; and performing a secondary operation on the ink holding chamber to increase the flow of ink to a distal part of the ink holding chamber relative to the flow of ink to a proximal part of the ink holding chamber, wherein the primary operation and the secondary operation are performed simultaneously, wherein performing a secondary operation on the ink holding chamber comprises applying a negative pressure at an opening into the distal part of the ink holding chamber and applying a positive pressure at an opening into the proximal part of the ink holding chamber, the opening into the proximal part of the ink holding chamber comprising an opening other than the ink ejection nozzles.

23. A method for introducing ink into an ink cartridge having ink ejection nozzles and an ink holding chamber, the method comprising:

performing a primary operation on the ink holding chamber by introducing ink into the ink holding chamber through the ink ejection nozzles; and performing a secondary operation on the ink holding chamber to increase the flow of ink to a distal part of the ink holding chamber relative to the flow of ink to a proximal part of the ink holding chamber, wherein the primary operation and the secondary operation are performed simultaneously, wherein performing a secondary operation on the ink holding chamber comprises introducing ink into the proximal part of the ink holding chamber through an opening into the proximal part of the ink holding chamber and applying a negative pressure at an opening into the distal part of the ink holding chamber, the opening into the proximal part of the ink holding chamber comprising an opening other than the ink ejection nozzles.

* * * * *